US006056138A

United States Patent [19]

Chen

[11] Patent Number: 6,056,138

[45] Date of Patent: May 2, 2000

[54] TRIPLE SEAL CONTAINER

[75] Inventor: Jeffrey Chen, Staten Island, N.Y.

[73] Assignee: Newspring Industrial Corp., East Newark, N.J.

[21] Appl. No.: 09/120,985

[22] Filed: Jul. 22, 1998

Related U.S. Application Data

[63] Continuation-in-part of application No. 29/066,299, Feb. 11, 1997, Pat. No. Des. 415,420, and a continuation-in-part of application No. 29/081,160, Dec. 23, 1997.

[51] Int. Cl.[7] ..... B65D 41/16

[52] U.S. Cl. ..... 220/4.21; 220/781; 220/792; 206/505

[58] Field of Search ..... 220/305, 780, 220/781, 782, 783, 790, 792, 796, 797, 798, 801, 802, 4.21, 4.24; 206/503, 505, 508, 515, 519

[56] References Cited

U.S. PATENT DOCUMENTS

| | | | |
|---|---|---|---|
| 2,798,631 | 7/1957 | Engel | 220/266 X |
| 3,861,433 | 1/1975 | Schier et al. | 220/793 X |
| 4,042,143 | 8/1977 | Biggins . | |
| 4,124,141 | 11/1978 | Armentrout et al. | 220/783 |
| 4,360,118 | 11/1982 | Stern | 220/4.24 |
| 4,466,552 | 8/1984 | Butterworth et al. | 220/798 |
| 4,555,043 | 11/1985 | Bernhardt | 220/783 |
| 4,844,263 | 7/1989 | Hadtke | 206/508 |
| 4,863,054 | 9/1989 | Capetta | 220/4.23 |
| 5,356,026 | 10/1994 | Andress et al. . | |
| 5,377,860 | 1/1995 | Littlejohn et al. . | |
| 5,395,003 | 3/1995 | Matsuda . | |
| 5,542,234 | 8/1996 | Wyslotsky et al. | 53/433 |
| 5,553,701 | 9/1996 | Jarecki et al. | 220/780 X |
| 5,666,875 | 9/1997 | Wener | 220/4.24 X |
| 5,758,791 | 6/1998 | Mangla | 220/780 X |
| 5,833,116 | 11/1998 | Guillin | 220/783 |

*Primary Examiner*—Nathan J. Newhouse
*Attorney, Agent, or Firm*—Gibbons, Del Deo, Dolan, Griffinger & Vecchione

[57] ABSTRACT

A triple sealed container, comprising a base portion and a lid portion. The base consisting of a unitary component including a bottom portion attached to an upwardly extending perimeter wall, which is flurther connected to a peripherally extending rim having an inner and outer edge. The lid also consists of a unitary component, with a downwardly extending wall, which is connected to a peripherally extending rim also having an inner and outer edge. The base edge and the lid edge are correspondingly shaped to be mateable. The lid rim is also correspondingly shaped to engage the base rim. The contact of the edges and the rims form three main seals. The first seal is a result of the contact between the exterior edges of the base edge and the lid edge. The second seal is a result of contact between the interior edges of the base edge and the lid edge. The first and second seals are shaped to provide a self-reinforcing seal configuration wherein the initial engagement of the first or second seals initiates the third seal. The third seal is a result of the peripherally extending base and lid rims contacting each other leaving a seal surface area greater than the areas of said first or second seals. This third seal provides substantially more protection against spoilage and spilling, by dramatically decreasing the odds of foreign substances contacting food products, or food products leaking into contact with surfaces exterior to the container. In addition, the assembly is stackable and same size nestable.

5 Claims, 6 Drawing Sheets

TRIPLE SEAL CONTAINER

RELATED APPLICATIONS

The present patent application is a continuation-in-part of U.S. patent application Ser. Nos. 29/066,299, having a filing date of Feb. 11, 1997, now U.S. Pat. No. D 415,420 and 29/081,160, having a filing date of Dec. 23, 1997. The applications having common inventors and assignees and being incorporated herein by reference.

FIELD OF THE INVENTION

This invention generally relates to containers for storing and transporting food, and in particular to a sealing component between a base and a rim.

BACKGROUND OF THE INVENTION

Container assemblies consisting of a lid and base portion for storing foods, are capable of being sealed to prevent leakage and spoilage. These containers require certain desirable features, most importantly, the ability to stop the flow of foods out of the container area and to prevent the introduction of bacteria and air into the container. Moreover, the container's lid and base should be easily assembled and disassembled for usage, so that the seals can be broken and resealed with minimal effort. A sealed container should also be stackable inside itself, in order to require a minimal storage space.

Although container assemblies having only one or two seals give acceptable results, food leakage can occur when one or both seals are broken. Typical double seal containers provide two identical seals, one interior to the other. The seals have small surface areas to prevent the flow of food, liquids and/or air. Disadvantageously, small surface areas can result in occasional failure. From a probability standpoint, if a single seal fails once every one-hundred times, the odds of two seals failing at once falls to one in ten-thousand. This is an unacceptable number of failures given the large number of containers in use.

Moreover, the potential hazards from spoilage and leakage of tainted foods are a great concern in both the food industry and at home. For example, the food can leak entirely from the container or be trapped between seals, potentially being exposed to contaminants and bacterium inducing spoilage or health hazards. A container which could provide both protection from outside bacterial contamination, and prevent leakage from food products inside the container would be greatly desired, be cost-effective, and be safer to use.

SUMMARY OF THE INVENTION

The present invention introduces a third seal with greater surface area to prevent leakage and promote food freshness. This is implemented through a series of three self-reinforcing seals which form both interior and exterior to the base periphery. The third, much larger seal, acts as an entry and exit barrier. Specifically, the third seal acts as a first line of defense against food product leakage and as a final defense against air and bacterium entering the container. Statistically, the odds of the two outer seals, and the third, inner seal, failing are one failure per one million plus uses.

In an exemplary embodiment of the present invention, a container includes a base, a lid and a set of three seals for releasably connecting the base and lid. An exterior and middle seal provide alignment between the base and lid to establish an interior seal having a greater sealing surface area.

Advantageously, three seal prevention of leakage and spoilage does not preclude easy assembly of the lid and base. The ability to break the seal, and remove or introduce food to the container, then close all three seals is relatively easily accomplished with the present invention. Neither the opening nor the closure of this invention are multi-step tasks. The closure involves no more than simple pressure on the lid and the sealing of one outer seal ensures the closure of the remaining seals.

The containers of the present invention are same size stackable, with one base fitting into the base of the next container, and the lids acting in the same fashion. This dramatically reduces the storage space required to keep large quantities of the invention. The present invention is, therefore, a safe and easy to use container that can be used in the food preparation and distribution industries and in the private home.

BRIEF DESCRIPTION OF THE DRAWINGS

For a detailed understanding of the present invention, reference should be made to the following detailed description taken in conjunction with the accompanying drawings wherein.

DETAILED DESCRIPTION

Figure 1:
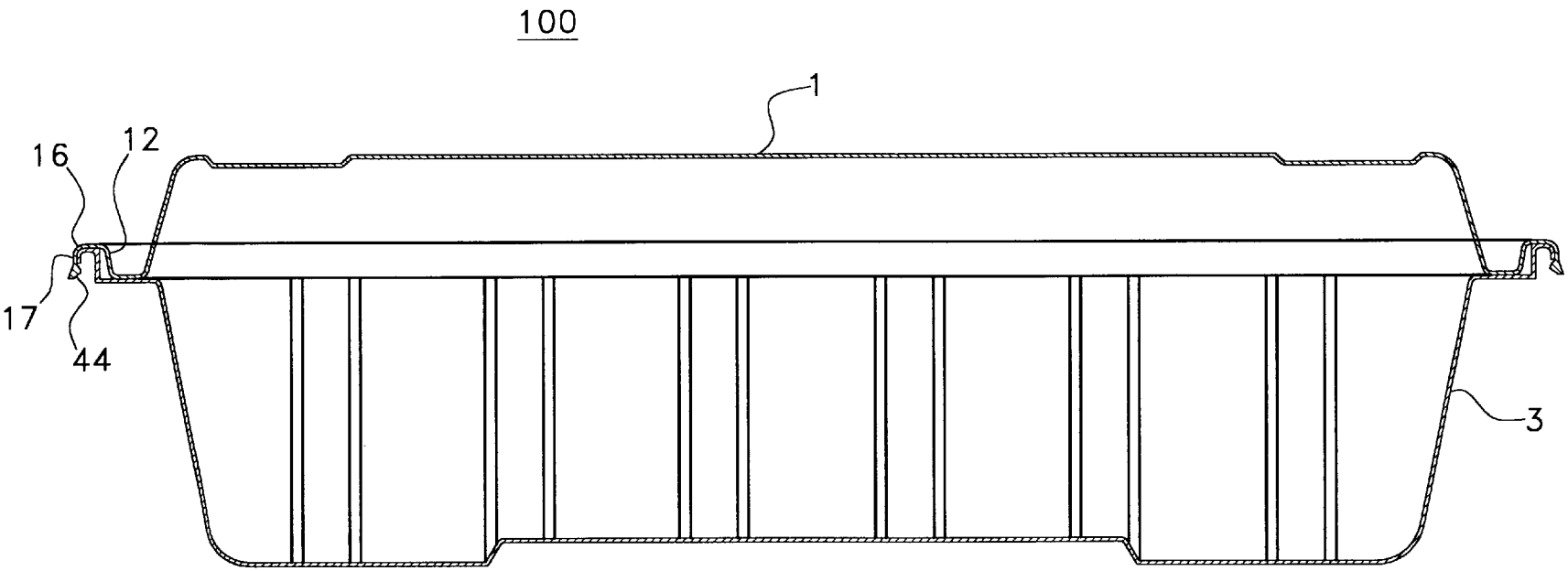
FIG. 1 is a side view of the container, with the lid sealed to the base.

Referring to FIG. 1, there is shown a container 100 that comprises a lid 1 and a base 3. Although container 100 is rectangular in configuration, container 100 may be, for example, round, square, oval, oblong, or any other desired shape.

Figure 2:
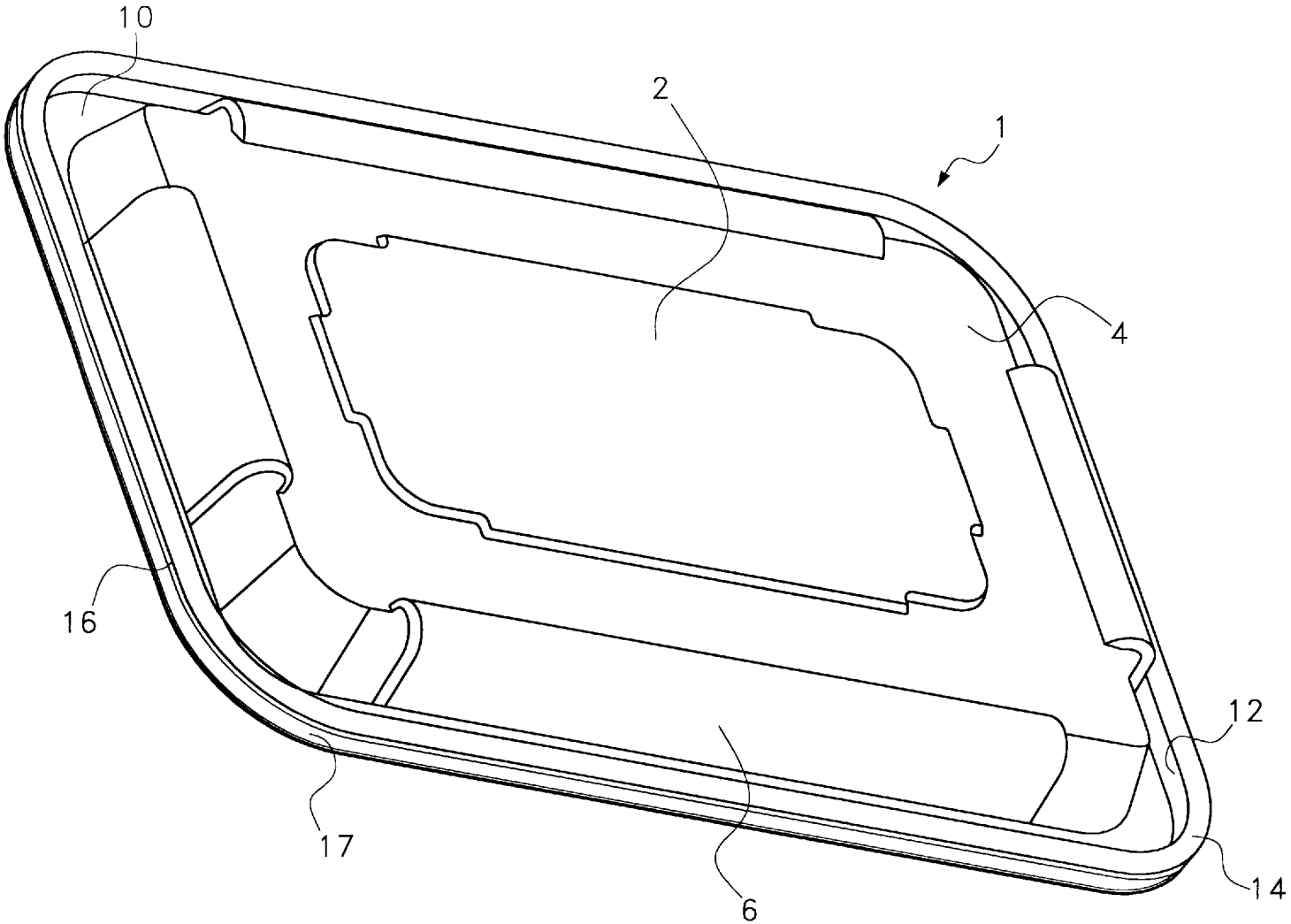
FIG. 2 is a perspective view of the lid.

Lid 1, which is fuirther illustrated in FIG. 2, includes a substantially planar top portion 4, with a slightly raised, substantially planar region 2 parallel to portion 4. Extending from the top portion 4 is a downwardly extending peripheral wall 6. A horizontally extending rim 10 is connected to downwardly extending peripheral wall 6. Rim 10 is also connected to generally perpendicular upwardly extending edge 12, which in turn is connected to outwardly extending lid region 14. Lid region 14 is further connected to downwardly extending lid region 16, which is also connected to downwardly extended region 17. Downwardly extended region 17 is generally parallel to upwardly extending edge 12. Downwardly extended region 17 ends in a locking lip 44, as illustrated in FIG. 1.

Figure 3:
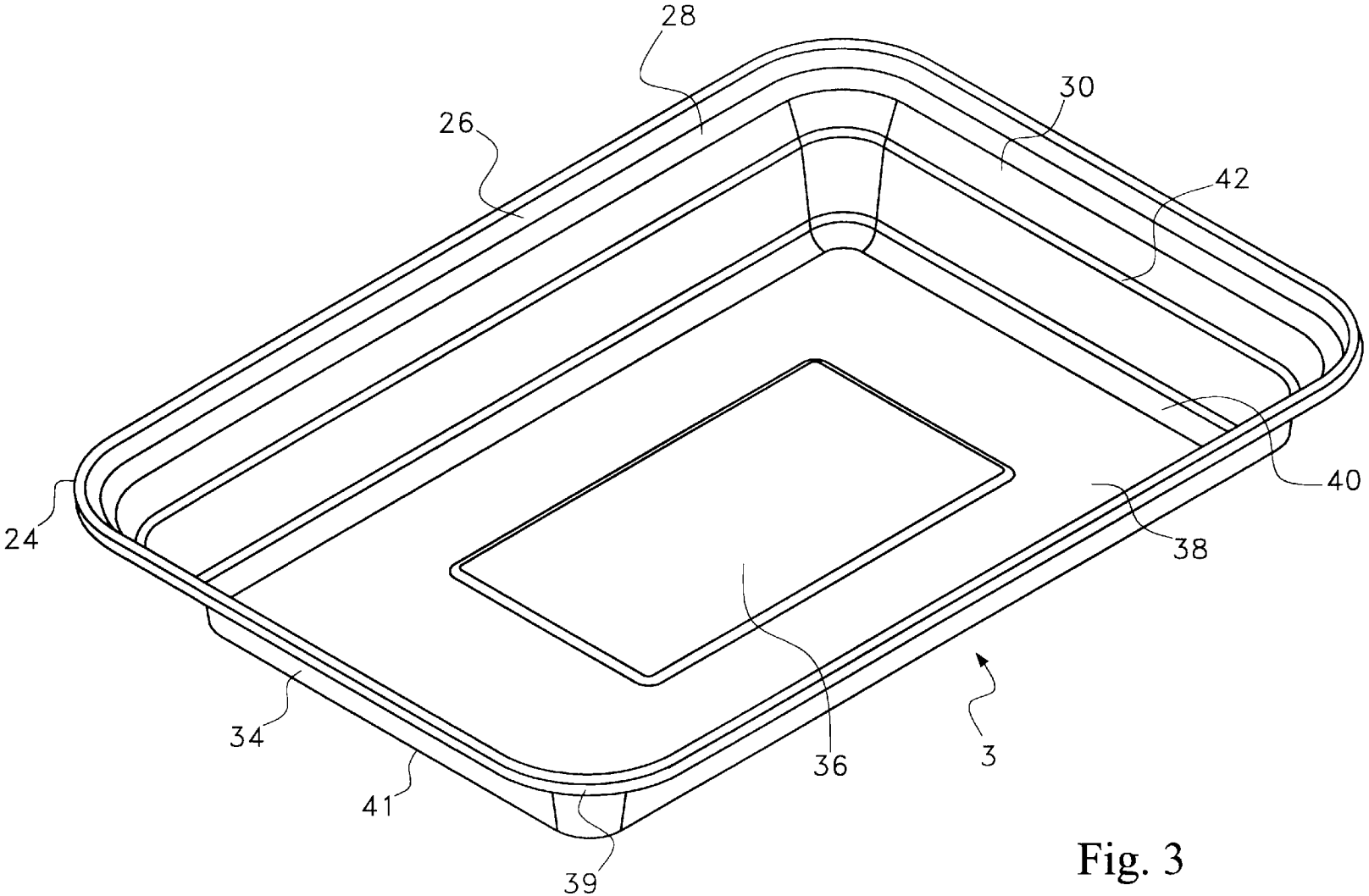
FIG. 3 is a perspective view of the base.

Referring to FIG. 3, a base 3 includes a substantially planar bottom portion 38, including a slightly raised, substantially planar region 36, that is parallel to bottom portion 38. Connected to the bottom portion 38, is a convex extension surface 40, which runs along the perimeter of base 31. From convex extension surface 40 extends an upwardly extending perimeter wall 34. Perimeter wall 34 ends in a generally horizontally extending base rim region 28. Base rim region 28 is integrally connected to a generally perpendicular upwardly extending base sealing edge 26, which ends in an outwardly extending surface 24, that is parallel to the rim region 28. Surface 24 terminates in a downwardly extending base sealing edge 39.

Figure 4:
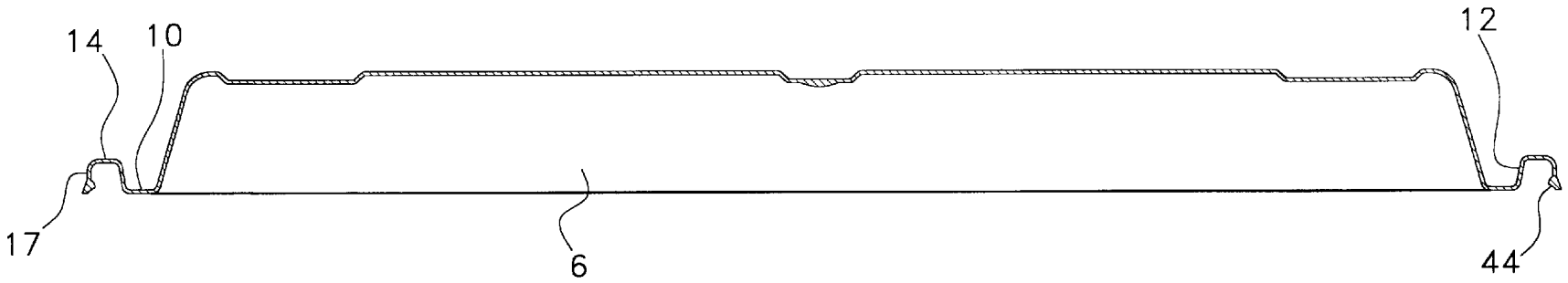
FIG. 4 is a cross section side view of the lid, showing a cut away section of the rim to indicate sealing regions.
Figure 5:
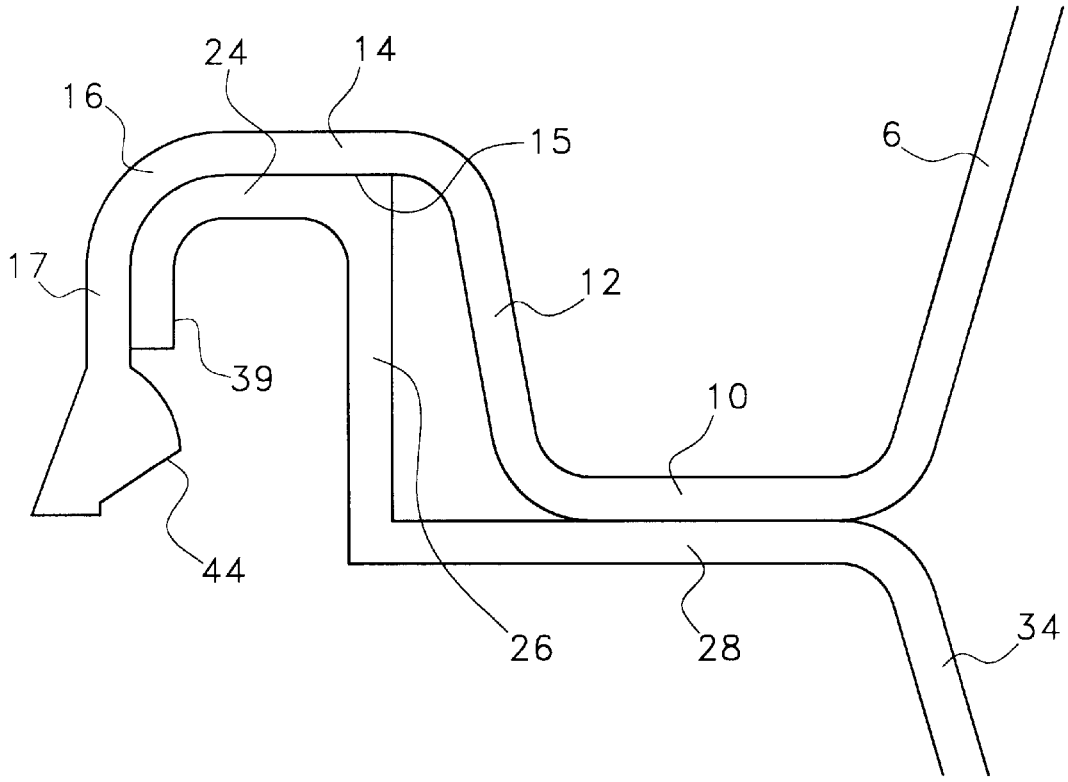
FIG. 5 is an enlarged view of the seal between the lid and the base.

Given the above structure, the interaction between the various lid and base components are now described with respect to FIGS. 1, 4 and 5. This interaction creates the triple seal formation of the present invention.

Lid 1 is pressed in a downward motion onto base 3. Lid 1 and base 3 are aligned by extended region 17 with locking lip 44 contacting downwardly extending base sealing edge 39.

Upon the application of downward pressure, locking lip 44 flexes extended region 17 outward at downwardly extending lid region 16 Further downward pressure on the lid 1 pushes locking lip 44 past the end of downwardly extending base sealing edge 39. Locking lip 44 then moves inwardly with extended region 17 flexing inwardly to contact downwardly extending base sealing edge 39. The resulting contact of downwardly extending lid region 16 to outwardly extending base sealing edge 24 of extending base sealing edge 26 creates the first seal. Contact of outwardly extending lid region 14 with base sealing edge 15 creates the second seal. Lid 1 and base 3 are held together with the locking lip 44 contacting the end of downwardly extending base sealing edge 39. The present invention's third seal is formed as horizontally extending rim 10 of the lid 1 is pressed against horizontally extending base rim region 28 of base 3.

The engagement of the first seal, between lid sealing edge 16 and base sealing edge 24, will urge the engagement of the second seal, between lid sealing edge 14 and base sealing edge 15 as well as the engagement of the third seal between base rim 28 and lid rim 10. Thus, the engagement of the outermost seal will assure proper alignment of the lid 1 on the base 3. Accordingly, a container having a reliable seal about the periphery, as well as an additional edge seal and a large interior third seal is provided.

The third seal is formed between between lid rim 10 and base rim 28, creating the interior seal. In the exemplary embodiment of the invention, the interior seal is larger than either the exterior seal or the middle seal. With the increased surface area, this interior seal acts as a larger first barrier against leakage from the container, and a superior final barrier against bacterium and contamination.

Figure 6:
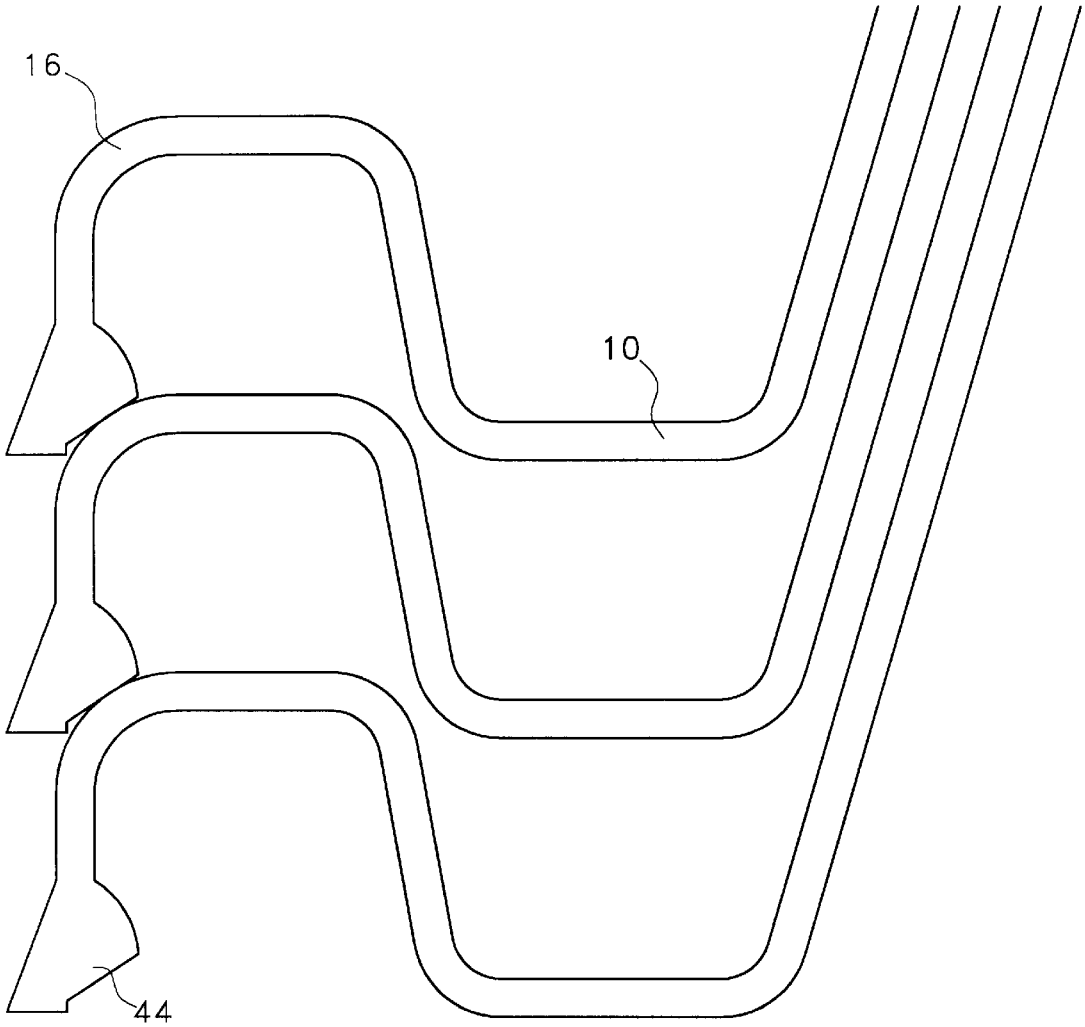
FIG. 6 is an enlarged view of three lids, stacked one on top of the next.

Referring now to FIGS. 1 and 6, it can be seen that the lids 1, and base portions 3, can be easily stacked in nested columns, lid upon lid and base upon base. The lids 1 are stackable since the locking lip 44 rests directly upon the outer edge 16 of the next lid. The bases are also stackable since the planar bottom portion 38 of one base rests upon the planar base portion 38 of the next base. In addition, horizontal rim 28 provides support for the next base rim 28. The stackability of the lids and bases provides a minimal stacking height and minimizes the required storage area.

In an alternative embodiment of the present invention, the container may take on an oval, or circular configuration. The critical components of both the lid 1 and base 3 remain substantially identical to those described herein As indicated, the present container is set forth, consisting of both a base portion and a lid portion. The container has an outer edge seal, a second edge seal interior to the first seal, and a third seal running along the periphery of the rim, interior to both the first and second seals. These seals are self-reinforcing and will be formed when the lid portion of the container is received by the base. The seals are self-reinforcing in that the engagement of the first seal will urge the second and third seals and ensure the alignment of the lid.

While the invention has been described with reference to preferred embodiments, it should be appreciated by those skilled in the art that the invention may be practiced, otherwise than as specifically described herein without departing from the scope of the invention. It is, therefore, to be understood that the scope of the invention be limited only by the appended.

What is claimed is:

1. A container having three seals, comprising:

a base having a substantially planar bottom, a base perimeter wall extending substantially vertically upward from said bottom, a base rim extending substantially horizontally outward from said base perimeter wall, and a base sealing edge attached to said base rim; and a lid having a substantially planar top, a lid perimeter wall extending substantially vertically downward from said top, a lid rim extending substantially horizontally outward from said lid perimeter wall, a lid sealing edge an ached to said lid rim, and a locking lip protruding from said sealing edge;

wherein said base sealing edge and said lid scaling edge are molded to be correspondingly mateable to each other and upon mating said base scaling edge and said lid sealing edge form a middle seal and an exterior seal and said base rim and said lid rim form an interior seal, wherein said interior seal has a surface area greater than said middle seal and said exterior seal, said base sealing edge further comprising an inner base edge extending generally vertically upward from said base rim; a middle base sealing edge extending substantially horizontally outward from said inner base edge; and an exterior base sealing edge extending substantially vertically downward from said middle base sealing edge; and said lid sealing edge further comprising an inner lid edge extending generally vertically upward from said lid rim; a middle lid sealing edge extending substantially horizontally outward from said inner lid edge; and an exterior lid sealing edge extending substantially vertically downward from said middle lid sealing edge, said locking lip protruding from said downward exterior lid sealing edge; wherein upon mating of said base and said lid, said base rim and said lid rim form said interior seal and said middle base sealing edge and said middle lid sealing edge form said middle seal and said exterior base sealing edge and said exterior lid sealing edge form said exterior seal.

2. A container according to claim 1, wherein at least a second base is stackable within said base.

3. A container according to claim 1, wherein at least a second lid is stackable within said lid.

4. A container according to claim 1, wherein the engagement of one of said exterior seal, said middle seal or said interior seal urges the engagement of the other two remaining seals.

5. A container having three seals, comprising:

a base having a substantially planar bottom, a base perimeter wall extending substantially vertically upward from said bottom, a base rim extending substantially horizontally from said base perimeter wall, and a base sealing edge having an inner base edge extending generally vertically from said base rim, a middle base sealing edge extending substantially horizontally from said inner base edge, and an exterior base scaling edge extending substantially vertically from said middle base sealing edge;

a lid having a substantially planar top, a lid perimeter wall extending substantially vertically downward from said top, a lid rim extending substantially horizontally from said lid perimeter wall, and a lid sealing edge having an inner lid edge extending generally vertically from said lid rim, a middle lid sealing edge extending substantially horizontally from said inner lid edge, and an exterior lid scaling edge extending substantially vertically from said middle lid sealing edge, and a locking lip protruding from said exterior lid scaling edge;

wherein, said base sealing edge and said lid sealing edge are molded to be correspondingly mateable to each other and upon mating of said bottom and said lid, said base rim and said lid rim form an interior seal, said middle base sealing edge and said middle lid sealing edge form a middle seal and said exterior base sealing edge and said exterior lip sealing edge form an exterior seal, and wherein, the engagement of one of said exterior seal, said middle seal or said interior seal urges the engagement of the other two remaining seals, and said interior seal has a surface area greater than said middle seal and said exterior seal.

* * * * *

UNITEDSTATESPATENTANDTRADEMARKOFFICE

CERTIFICATEOFCORRECTION

PATENTNO: 6,056,138

DATED: May 2, 2000

INVENTOR(S): Jeffrey Chen

Itiscertifiedthaterrorappearsintheabove-identifiedpatentandthatsaidLettersPatent isherebycorrectedasshownbelow:

In column 4, line 23 please change "an ached to" to - - attached to--;

In column 4, line 27, please change "base scaling edge" to --base sealing edge--;

In column 5, line 16 please change "lid scaling edge" to --lid sealing edge--; and In column 6, line 1 please change "lid scaling edge" to --lid sealing edge--.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*